US006205917B1

(12) United States Patent
Palmer et al.

(10) Patent No.: US 6,205,917 B1
(45) Date of Patent: Mar. 27, 2001

(54) TUBE PRINTER FOR PRINTING INFORMATION ON THE INSIDE OF A TUBE AND METHOD OF PRINTING

(75) Inventors: Donald Thomas Palmer, Irvona; Robert Alan Kokal, State College, both of PA (US); James Michael Swartz, Huntingdon, PA (US)

(73) Assignee: Owens Corning Fiberglas Technology, Inc., Summit, IL (US)

( * ) Notice: Subject to any disclaimer, the term of this patent is extended or adjusted under 35 U.S.C. 154(b) by 0 days.

(21) Appl. No.: 09/164,546

(22) Filed: Oct. 1, 1998

(Under 37 CFR 1.47)

(51) Int. Cl.[7] ..... B41F 17/22

(52) U.S. Cl. ..... 101/35; 101/329; 101/375; 101/DIG. 39; 101/483

(58) Field of Search ..... 101/35, 36, 327, 101/328, 329, 333, 483, DIG. 39, 375, 405, 368

(56) References Cited

U.S. PATENT DOCUMENTS

| | | | | |
|---|---|---|---|---|
| 330,804 | * | 11/1885 | Rodwell | 101/375 |
| 518,118 | * | 4/1894 | Rose | 101/375 |
| 772,352 | * | 10/1904 | Haller | 101/171 |
| 2,326,954 | | 8/1943 | MacAnlis | 101/35 |
| 2,548,580 | | 4/1951 | Bick | 101/331 |
| 2,778,305 | * | 1/1957 | Gottscho et al. | 101/329 |
| 3,037,235 | | 6/1962 | Goggans | 101/330 |
| 3,905,295 | | 9/1975 | Bielesch et al. | 101/364 |
| 4,667,594 | * | 5/1987 | Eddy | 101/35 |

* cited by examiner

*Primary Examiner*—John S. Hilten
*Assistant Examiner*—Leslie J. Grohusky
(74) *Attorney, Agent, or Firm*—Inger H. Eckert

(57) ABSTRACT

A tube printer and method for printing information on an interior surface of a tube. The tube printer including a housing, an ink wheel assembly and a print wheel. The housing having at least two side members interconnected by a top plate extending there between and including spring biased guide wheels that cooperatively center the housing within the tube. An operating handle is operatively attached to an end of the housing to provide a means to push and pull the tube printer within the tube. The ink wheel assembly is operatively positioned between the side members of the housing and the print wheel is operatively positioned between the side members of the housing and adjacent the ink wheel and includes a raised surface containing the information to be printed on the interior surface of the tube.

18 Claims, 3 Drawing Sheets

TUBE PRINTER FOR PRINTING INFORMATION ON THE INSIDE OF A TUBE AND METHOD OF PRINTING

TECHNICAL FIELD AND INDUSTRIAL APPLICABILITY OF THE INVENTION

The present invention relates to a tube printer for printing information on the inside of a tube and a method of using the tube printer. More particularly, the present invention relates to a tube printer for printing information such as the date of manufacture and the product size on the inside of a tube, such as a cardboard tube containing an article for the purpose of quality control and/or identification and a method of using the tube printer.

BACKGROUND OF THE INVENTION

There are a wide variety of packaging systems and methods for the immobilization, packaging and transporting of articles. The various methods include, but are not limited to, the employment of corrugated boxes, plastic film laminates, polyurethane foam that is foamed in place around an article, loose fill foam poured over an article protected in an outer container, bubble wraps and the like. The type of packaging system utilized often depends upon the shape of the article to be immobilized, packaged and transported. For example, tubular articles may be transported in a cardboard tube. As a convenience to the recipient and to the shipper, packaging systems for transporting tubular articles in a tube typically may contain information printed on the inside of the tube. Printing information on the inside of the tube allows the shipper and recipient to select similar articles for their needs. It will be appreciated that information that is usually printed on the outside of the tube is covered by the product, thus making it impossible to select similar articles prior to use.

Heretofore, the information was printed on the inside of the tube on flat stock material and then the tube was formed from the stock material. It will be appreciated that a difficulty in manufacturing and identifying the tubes in this manner is that is that it is virtually impossible for the shipper of the tube to inventory the correct number of tubes needed for a particular article on a particular date. Consequently, on some days there may be a surplus or a shortage of tubes with the correct information for a particular article.

In view of the foregoing, it is an object of the present invention to provide a method and apparatus for printing information on the interior wall of a tube container after the tube container is manufactured. It is another object of the present invention to provide a method and apparatus for printing information on the interior wall of a tube container that is simple to manufacture and economical to operate. It is another object of the present invention to provide a method and apparatus capable of interchangeably printing information on the interior wall of a tube container. Yet another object of the present invention is to provide a method and apparatus that allows the operator to change information to be printed and the print color.

SUMMARY OF THE INVENTION

Briefly, there is provided a tube printer for printing information on an interior surface of a tube and a method operating the tube printer. The tube printer includes a housing, an ink wheel assembly and a print wheel. The housing has at least two side members interconnected by a top plate extending there between. The housing also includes spring biased guide wheels that cooperatively center the housing within the tube and an operating handle operatively attached to an end of the housing to provide a means to push and pull the tube printer within the tube. The ink wheel assembly and the print wheel are operatively positioned between the side members of the housing and adjacent one another. The ink wheel includes a raised surface containing the information to be printed on the interior surface of the tube.

The tube printer is operated by inserting the tube printer within an open end of the tube whereby the spring biased guide wheels force the print wheel onto an interior surface of the tube and then moving the tube printer over the interior surface of the tube to print information on the interior surface of the tube.

BRIEF DESCRIPTION OF THE DRAWINGS

Further features and other objects and advantages of this invention will become clear from the following detailed description made with reference to the drawings in which.

DESCRIPTION AND PREFERRED EMBODIMENTS OF THE INVENTION

Figure 1:
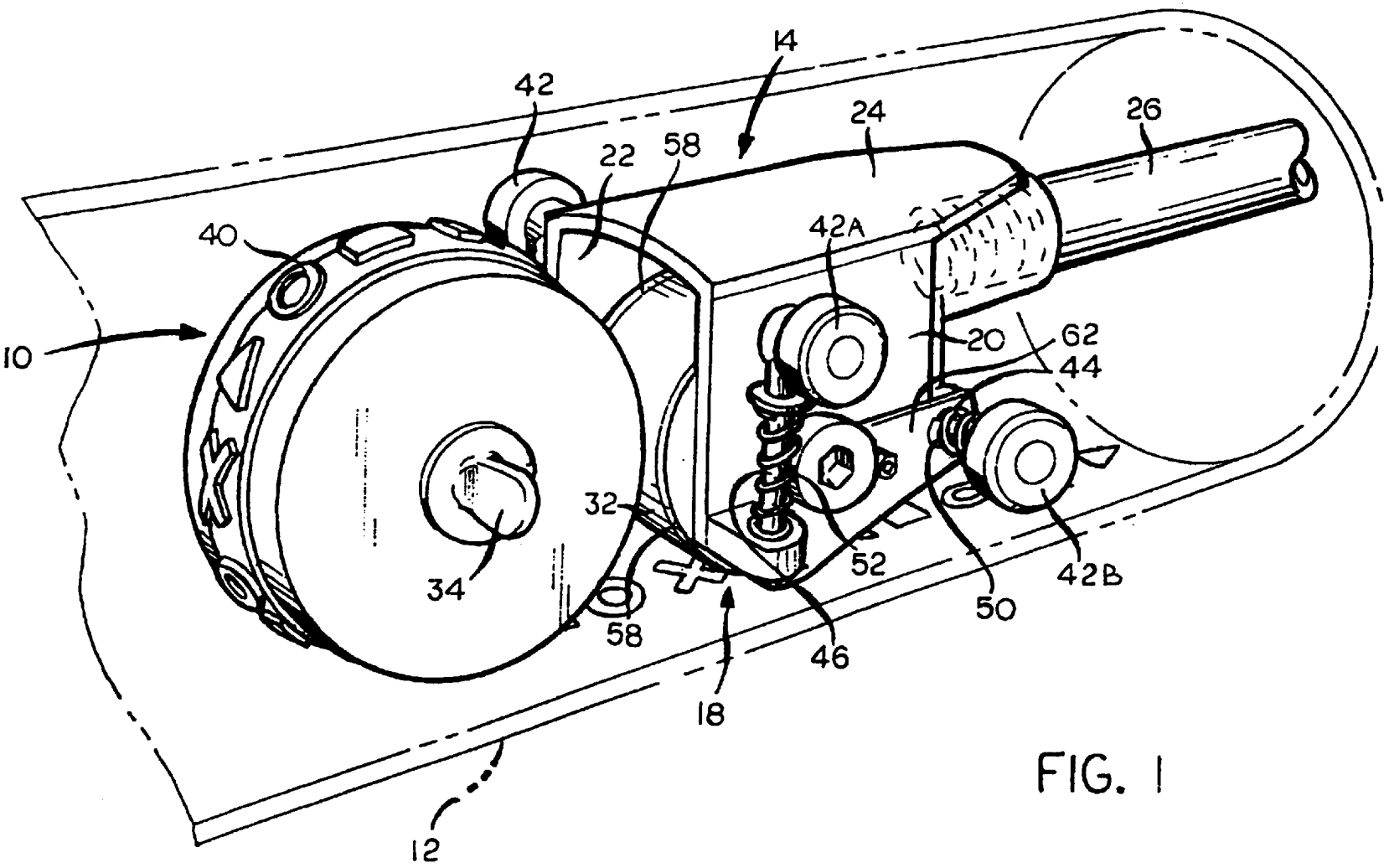
FIG. 1 is a perspective view of the tube printer in accordance with the present invention within a tube.
Figure 2:
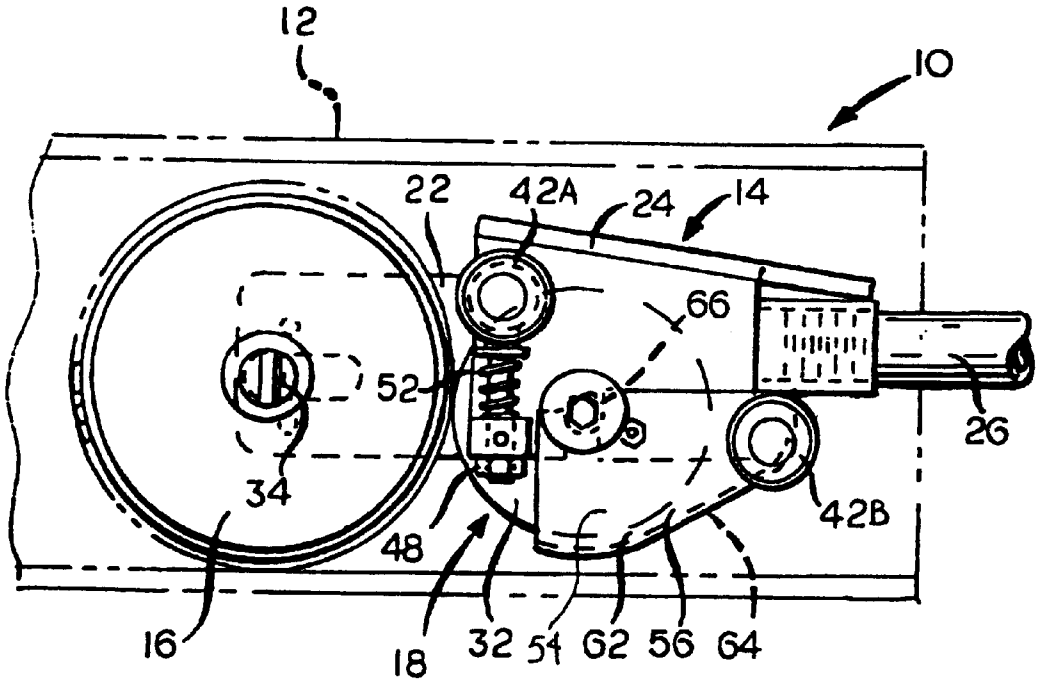
FIG. 2 is a side view of the tube printer in accordance with the present invention.
Figure 3:
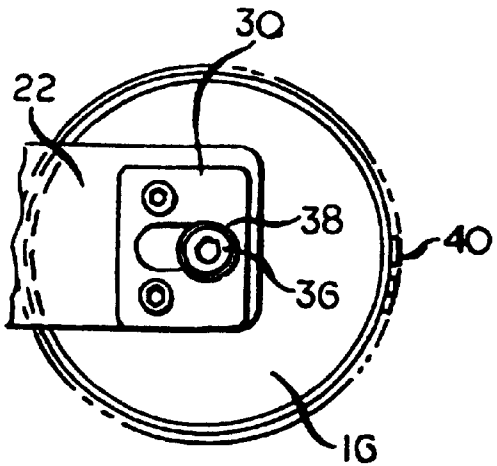
FIG. 3 is a partial side view of the print wheel and adjusting plate of the tube printer.
Figure 4:
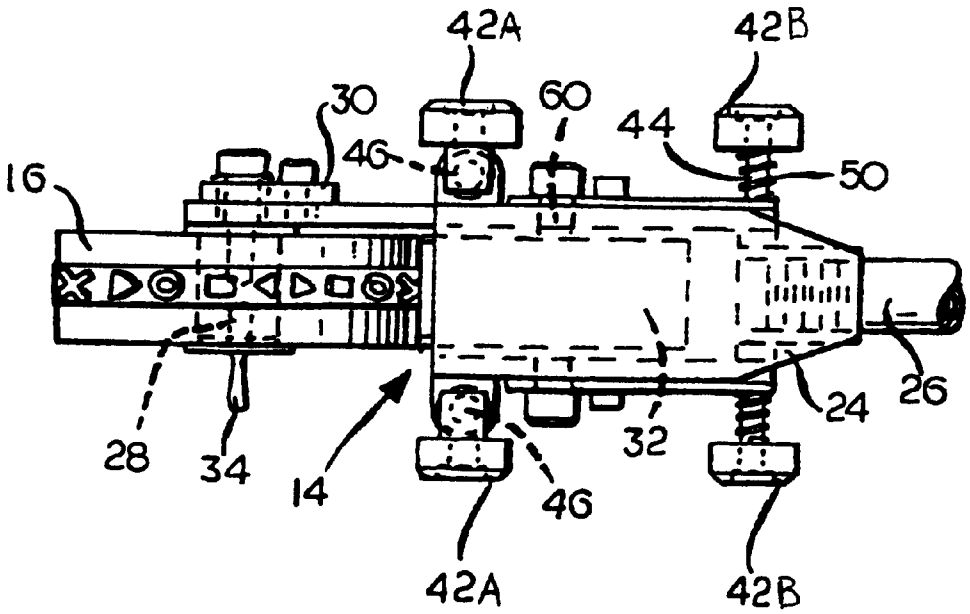
FIG. 4 is a top view of the tube printer in accordance with the present invention and FIG. 5 is an end view of the tube printer in accordance with the present invention.
Figure 5:
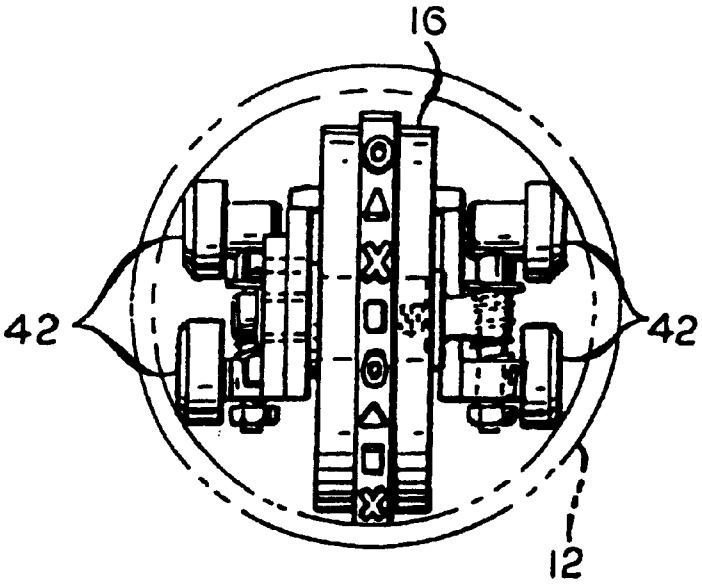

Referring to the figures wherein like reference characters represent like elements, there is shown a tube printer 10. In the following description, it will be appreciated that terms such as top, bottom, forward, rearward and the like are relative terms of convenience and are not to be construed as limiting terms apart from the invention as claimed. Furthermore, it will be appreciated that the tube printer 10 may be formed of a variety of materials such as metal, plastic and the like and of elements of different sizes to accommodate different size tubes 12.

As shown in FIG. 1, the tube printer 10 includes a housing 14, a print wheel 16 and an ink wheel assembly 18. The housing 14 includes at least two side members 20 and 22 interconnected along a top edge by a top plate 24 extending there between. An operating handle 26 of a type well known in the art may be operatively attached to the rearward end of the housing 14 to provide a means to move the tube printer by pushing and pulling the tube printer 10 within the tube 12.

The housing 14 includes guide wheels that cooperatively center the housing within the tube 12. The guide wheels include a rearward pair of guide wheels 42B operatively mounted for rotation about axle 44 and a top pair of guide wheels 42B mounted for rotation about L-shaped spring guides 46. The height of the L-shaped spring guides 46 may be adjusted by varying the relative position of fastener 48 with respect to the length of the spring guide. The rearward pair of guide wheels 42B are spring biased in a horizontal outward direction by compression springs 50. A compression spring 50 is placed over the axle 44 between the housing 14 and the guide wheel 42B to urge each rearward guide wheel in opposing directions away from the housing and against the sidewall of the tube 12. The top pair of guide wheels 42A are spring biased in a vertical direction by compression springs 52 placed over each L-shaped spring guide 46 between the housing 14 and the guide wheel. The compression springs 52 urge the top pair of guide wheels 42A against the top of the tube 12 and force the print wheel 16 downward against the bottom surface of the tube. The rearward pair of guide wheels 42B and top pair of guide wheels cooperatively function to center the housing 14 within the tube 12 and to maintain the ink wheel 32 away from the tube surface. It will be appreciated that because the guide wheels 42B are spring biased, the amount of compression of the springs 50 on the axle 44 allows tube printer 10 to fit within a variety of tube diameters. In addition, the tube printer 10 may fit within a variety of tube diameters by varying the length of the L-shaped spring guides exposed above the fastener 48 and the length of the axle.

The print wheel 16 and the ink wheel assembly 18 of the tube printer 10 are operatively positioned between the side members 20 and 22 of the housing 14. As shown in FIGS. 1–5, the print wheel 16 is mounted for rotation about a print wheel axle 28. In a preferred embodiment, the print wheel axle 28 is operatively attached to a print wheel adjusting plate 30 that is removably attached to the housing 14. The print wheel adjusting plate 30 may be adjusted to maintain the peripheral surface of the print wheel 16 against the peripheral surface of the adjacent ink wheel 32 as further described below.

The print wheel 16 is connected to the print wheel axle 28 by a suitable fastener 34 such as a thumb screw and attached for horizontal movement to the print wheel adjusting plate 30 by screw 36 and bushing 38. The print wheel adjusting plate 30 and the housing 14 cooperatively provide forward and rearward adjustment of the print wheel 16 relative to the ink wheel 32. As shown in FIG. 1, the print wheel 16 includes a raised surface 40 containing information to be printed on the interior surface of the tube 12. The raised surface 40 may be formed integral with the print wheel 16 or formed separate from the print wheel and attached to the print wheel as well known in the printing art.

Positioned adjacent the print wheel 16 is an ink wheel assembly 18. The ink wheel assembly 18 is removably attached to the side members 20 and 22 of the housing 14 from below. The ink wheel assembly 18 includes an ink wheel cover 54 and a cylindrical wheel 32 positioned between two spacer members 58 and mounted for rotation on a horizontal ink wheel axle 60. The cylindrical wheel 32 may be formed of most any cellular or sponge like material that will absorb and hold ink.

The ink wheel cover 54 has two longitudinally extending side members 62 interconnected along a bottom edge by a curved bottom plate 64 that extends upwardly and rearwardly. Each upwardly projecting side member 62 of the ink well cover 54 includes an upwardly facing slot 66. The ink wheel 32 and members 58 are mounted for rotation about the horizontal ink wheel axle 60 received within the slots 66 formed within the side members 62 of the ink wheel cover 54. Ink from the cylindrical wheel 32 is transferred to the print wheel 16 through direct contact of the peripheral surfaces of the cylindrical wheel and the print wheel.

The operation of the tube printer 10 is accomplished by manually inserting the tube printer into an open end of the tube 12. As the tube printer 10 is pushed into the tube 12, the spring biased guide wheels 42A force the print wheel 16 onto the interior surface of the tube 12. The pair of spring biased guide wheels 42B mounted on the rear of the tube printer 10 prevent the ink wheel 32 from dragging across the printed information. When the tube printer 10 reaches the opposite end of the tube 12 the tube printer is rotated about 180 degrees and brought back through the tube printing information on the opposite side of the tube.

It is a feature of the present invention that the print wheel 16 and/or the ink wheel 32 may be easily removed and replaced as necessary. Accordingly, the information printed on the inside of the tube may be changed by merely changing the print wheel 16 and a variety of colors may be used by merely varying the color of the ink on the ink wheel 32.

The patents and documents described herein are hereby incorporated by reference.

Having described presently preferred embodiments of the invention, the invention may be otherwise embodied within the scope of the appended claims.

What is claimed is:

1. A tube printer for printing information on an interior surface of a tube comprising:

a housing including at least two side members and a top plate, said at least two side members depending from the top plate, the housing including spring biased guide wheels that cooperatively center the housing within the tube and an operating handle operatively attached to an end of the housing to provide a means to push and pull the tube printer within the tube;

an ink wheel assembly operatively positioned between the side members of the housing; and a print wheel operatively positioned between the side members of the housing and adjacent the ink wheel assembly and including a raised surface containing the information to be printed on the interior surface of the tube.

2. The tube printer of claim 1 further comprising a print wheel adjusting plate removably attached to the housing, wherein the print wheel adjusting plate may be adjusted to maintain the peripheral surface of the print wheel against the peripheral surface of the ink wheel assembly.

3. The tube printer of claim 1 wherein the guide wheels include a rearward pair of guide wheels and a top pair of guide wheels, wherein the rearward pair of guide wheels are spring biased in a horizontal outward direction and the top pair of guide wheels are spring biased in a vertical direction.

4. The tube printer of claim 3 wherein said housing comprises L-shaped spring guides, each of top guide wheels being mounted on said L-shaped spring guides.

5. The tube printer of claim 2 wherein the print wheel is attached to a print wheel axle that is attached for horizontal movement to the print wheel adjusting plate.

6. The tube printer of claim 1 wherein the raised surface is formed integral with the print wheel.

7. The tube printer of claim 1 wherein the raised surface is formed separate from the print wheel.

8. The tube printer of claim 1 wherein the ink wheel assembly is removably attached to the side members of the housing.

9. The tube printer of claim 1 wherein the ink wheel assembly includes an ink wheel cover, a cylindrical wheel, and two spacer members, said cylindrical wheel being positioned between two spacer members and mounted for rotation on a horizontal ink wheel axle, the ink wheel cover having two longitudinally extending side members interconnected by a curved bottom plate that extends upwardly and rearwardly, each longitudinally projecting side member of the ink wheel cover including an upwardly facing slot to receive the ink wheel axle.

10. A tube printer for printing information on an interior surface of a tube comprising:

a housing including at least two side members and a top plate, said at least two side members depending from the top plate, the housing including spring biased guide wheels that cooperatively center the housing within the tube and an operating handle operatively attached to an end of the housing to provide a means to move the tube printer within the tube, attached to the housing is a print wheel adjusting plate;

an ink wheel assembly operatively positioned between the side members of the housing; and a print wheel operatively positioned between the side members of the housing and adjacent the ink wheel assembly and including a raised surface containing the information to be printed on the interior surface of the tube, wherein the print wheel is rotatably mounted to a print wheel axle that is attached for horizontal movement to the print wheel adjusting plate.

11. The tube printer of claim 10 wherein the ink wheel assembly is removably attached to the housing.

12. The tube printer of claim 11 wherein the guide wheels include a rearward pair of guide wheels and a top pair of guide wheels, wherein the rearward pair of guide wheels are spring biased in a horizontal outward direction and the top pair of guide wheels are spring biased in a vertical direction.

13. The tube printer of claim 12 wherein each top guide wheel is mounted on an L-shaped spring guide.

14. The tube printer of claim 13 wherein the raised surface is formed integral with the print wheel.

15. The tube printer of claim 13 wherein the raised surface is formed separate from the print wheel.

16. The tube printer of claim 13 wherein the ink wheel assembly is removably attached to the side members of the housing.

17. The tube printer of claim 11 wherein the ink wheel assembly includes an ink wheel cover, a cylindrical wheel, and two spacer members, said cylindrical wheel being positioned between two spacer members and mounted for rotation on a horizontal ink wheel axle, the ink wheel cover having two longitudinally extending side members interconnected by a curved bottom plate that extends upwardly and rearwardly, each longitudinally projecting side member of the ink wheel cover including an upwardly facing slot to receive the ink wheel axle.

18. A method of printing information on an interior surface of a tube comprising the steps of:

providing a tube printer having a housing including at least two side members and a top plate, said at least two side members depending from the top plate, the housing including spring biased guide wheels that cooperatively center the housing within the tube and an operating handle operatively attached to an end of the housing to provide a means to push and pull the tube printer within the tube, an ink wheel assembly operatively positioned between the side members of the housing, and a print wheel operatively positioned between the side members of the housing and adjacent the ink wheel assembly and including a raised surface containing the information to be printed on the interior surface of the tube;

inserting the tube printer into an open end of the tube whereby the spring biased guide wheels force the print wheel onto an interior surface of the tube; moving the tube printer over the interior surface of the tube thereby printing information on the interior surface of the tube.

* * * * *